US007992636B2

(12) United States Patent
Telfer

(10) Patent No.: US 7,992,636 B2
(45) Date of Patent: Aug. 9, 2011

(54) DEVICE AND METHOD FOR RETRIEVING DEBRIS FROM A WELL

(75) Inventor: George Telfer, Aberdeen (GB)

(73) Assignee: Specialised Petroleum Services Group Limited, Aberdeen, Aberdeenshire (GB)

( * ) Notice: Subject to any disclaimer, the term of this patent is extended or adjusted under 35 U.S.C. 154(b) by 0 days.

(21) Appl. No.: 11/914,448

(22) PCT Filed: May 12, 2006

(86) PCT No.: PCT/GB2006/001752

§ 371 (c)(1),
(2), (4) Date: Nov. 14, 2007

(87) PCT Pub. No.: WO2006/123109

PCT Pub. Date: Nov. 23, 2006

(65) Prior Publication Data

US 2009/0126933 A1 May 21, 2009

(30) Foreign Application Priority Data

May 17, 2005 (GB) ..... 0509962.7

(51) Int. Cl.
*E21B 31/00* (2006.01)
*E21B 31/06* (2006.01)

(52) U.S. Cl. ..... 166/99; 166/301; 166/312

(58) Field of Classification Search ..... 166/301, 166/312, 99, 311, 56, 170, 173, 177.3, 177.1
See application file for complete search history.

(56) References Cited

U.S. PATENT DOCUMENTS

| | | | | |
|---|---|---|---|---|
| 2,072,627 A | | 3/1937 | Zublin | |
| 3,023,810 A | * | 3/1962 | Anderson | 166/99 |
| 3,198,256 A | * | 8/1965 | Kirby, II | 166/99 |
| 3,203,491 A | * | 8/1965 | Turley | 175/235 |

(Continued)

FOREIGN PATENT DOCUMENTS

| | | |
|---|---|---|
| WO | 9922112 | 5/1999 |

(Continued)

OTHER PUBLICATIONS

Written Opinion of the International Searching Authority corresponding to International Application PCT/GB2006/001752 dated Aug. 28, 2006, (7 pages).

*Primary Examiner* — William P Neuder
*Assistant Examiner* — Elizabeth C Gottlieb
(74) *Attorney, Agent, or Firm* — Osha Liang LLP

(57) ABSTRACT

A device for use in retrieving debris from a well, including an elongate body; a main bore extending part way along a length of the body; an opening towards a lower end of the body; a main fluid chamber in the body in fluid communication with the main bore; a flow restriction provided in the main bore, through which fluid flows from the main bore and into the main fluid chamber; at least one chamber outlet for directing fluid from the main fluid chamber into an annulus defined between the device and a well borehole wall; a return flow passage extending between the body opening and the main fluid chamber, for return flow of fluid from the annulus to the main fluid chamber, to facilitate retrieval of debris from the well; and at least one fluid exit, for flow of fluid out of the device.

31 Claims, 9 Drawing Sheets

U.S. PATENT DOCUMENTS 4,296,822 A * 10/1981 Ormsby ..... 175/249
4,545,432 A 10/1985 Appleton et al.
4,744,420 A * 5/1988 Patterson et al. ..... 166/312
5,083,609 A * 1/1992 Coleman ..... 166/68
5,086,842 A * 2/1992 Cholet ..... 166/312
5,402,850 A 4/1995 Lalande et al.
6,176,311 B1 * 1/2001 Ryan ..... 166/99
6,453,996 B1 * 9/2002 Carmichael et al. ..... 166/177.3
2004/0094302 A1 * 5/2004 Booth ..... 166/311

FOREIGN PATENT DOCUMENTS

WO 2004088091 10/2004

* cited by examiner

DEVICE AND METHOD FOR RETRIEVING DEBRIS FROM A WELL

BACKGROUND OF INVENTION

1. Field of the Invention

The present invention relates to a device for use in retrieving debris from a well and to a corresponding method. In particular, but not exclusively, the present invention relates to a device for use in retrieving debris from a well of a type which circulates fluid into an annulus defined between the device and a well borehole wall.

2. Background Art

In the oil and gas exploration and production industry, it is frequently necessary to carry out a procedure to retrieve debris from a well. For example, debris such as part of a tool or tool string or other "junk" can become stuck or lodged downhole and requires to be retrieved to surface in a "fishing" operation, such that a further well procedure may be carried out, or such that an existing procedure may be continued. Also, it is frequently necessary to clean a well by retrieving debris particles which have collected in a casing-lined borehole, before the well can be completed by installation of production tubing. Such debris particles may include cement lumps, rocks, congealed mud, oxidation lumps, metal debris, scale, slivers, shavings and burrs, for example.

U.S. Pat. No. 4,545,432 (Robert T. Appleton) discloses a wash-over type downhole retrieving device or fishing tool consisting of a hollow cylindrical body having an open lower end. The body has concentric inner and outer walls defining an annular space in which an annular piston can force down an annular sleeve of a malleable alloy having downwardly extending finger-like formations. The inside of the lower end of the outer wall is of cupped configuration effective to deflect the fingers inwards and over the open end of the body, so as to trap and retain an object for retrieval. The annular piston is forced down hydraulically by dropping a diverter ball valve and cutting teeth are optionally provided on the outer periphery of the lower end of the outer wall, on a detachable shoe. Tools of the type disclosed in U.S. Pat. No. 4,545,432 are not suited for the purpose of retrieving debris other than objects forming part of a downhole tool or tool string, and do not provide fluid circulation to the annulus during retrieval of objects.

Reverse circulating junk basket tools have also been developed which circulate fluid from the tool into the annulus, the fluid travelling along the annulus into a lower tool opening, and returning to the annulus at an upper location. These tools may include finger shoes for retrieving loose junk on the bottom of the hole, the fingers designed to close in beneath an object when slowly lowered during rotation. These tools suffer from disadvantages including that the flow rate of fluid to the annulus is insufficient to effectively retrieve loose debris, and that a large portion of the fluid directed into the annulus is lost uphole, rather than circulated downhole and into a lower opening of the tool.

It is amongst the objects of embodiments of the present invention to obviate or mitigate at least one of the foregoing disadvantages.

SUMMARY OF INVENTION

According to a first aspect of the present invention, there is provided a device for use in retrieving debris from a well, the device comprising:

an elongate body;

a main bore extending part way along a length of the body, along which fluid flows into the device;

an opening towards a lower end of the body;

a main fluid chamber in the body in fluid communication with the main bore;

a flow restriction provided in the main bore, through which fluid flows from the main bore and into the main fluid chamber;

at least one chamber outlet for directing fluid from the main fluid chamber into an annulus defined between the device and a well borehole wall;

a return flow passage extending between the body opening and the main fluid chamber, for return flow of fluid from the annulus to the main fluid chamber, to facilitate retrieval of debris from the well; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

The invention therefore provides a device for use in retrieving debris from a well where a greater flow rate of fluid into the annulus can be provided for a given flow rate of fluid entering the device along the main bore. This is achieved by recirculating part of the fluid returned to the main fluid chamber into the annulus. This facilitates use of the device for retrieving a wide range of sizes and weights of debris from a well, ranging from relatively large debris such as part of a tool, tool string or other junk located downhole, to smaller debris entrained in the fluid entering the device, such as drill cuttings or the like.

The device may be a reverse-circulation device.

The device generates a suction, in use, due to flow of fluid from the main bore through the restriction and into the main fluid chamber, drawing said part of the fluid returned to the chamber along the return flow passage into and along the chamber outlet. The restriction thus defines or provides at least part of a Venturi, creating a Venturi-like effect on the fluid flowing through the main bore.

It will be understood that references herein to "debris" include relatively small matter or items entrained in fluid circulated into the annulus (such as drill cuttings), and larger components, such as parts of a tool or tool string. The device may therefore optionally be utilised for "fishing" a tool, part of a tool or string or other junk from a well, where flow of fluid from the annulus, into the opening and along the return flow passage to the chamber assists in washover of the tool over the debris to be retrieved.

Preferably, the device comprises a seal member for sealing the annulus, to substantially prevent or restrict flow of fluid along the annulus in an uphole direction. Accordingly, the seal member may ensure that all or most of the fluid directed into the annulus along the chamber outlet is circulated downhole and enters the tool through the tool opening, which may facilitate optimum retrieval of debris from the well.

The chamber outlet may comprise a flow port through which fluid flows to annulus. The fluid exit may be adapted to discharge fluid from the device to the annulus, and may comprise a fluid exit flow port through which fluid flows to the annulus. The seal member may be located axially between the chamber outlet flow port and the fluid exit flow port. In this fashion, the seal member may define a barrier between the fluid entering the annulus along the chamber outlet and the fluid exiting the device along the fluid exit into the annulus. This may provide a supercharging effect, ensuring that all or substantially all of the fluid flowing to annulus along the chamber outlet is directed downhole and re-enters the device through the body opening.

The seal member may be a generally annular member, and may take the form of a sleeve, collar, wiper or the like which may be adapted to sealingly engage or abut the well borehole wall. The seal member may permit axial movement of the device relative to the well borehole wall whilst retaining a sealing function. This may facilitate run-in and run-out of the device, and thus translation of the device relative to the well borehole. In embodiments of the invention, the seal member may comprise a diverter cup, and may be axially moveable relative to the elongate body to selectively permit fluid flow along the annulus past the seal member. For example, the device, and in particular the elongate body, may comprise a bypass slot or channel and the diverter cup may be moveable between a position where the bypass slot is closed and a position where the bypass slot is open, facilitating fluid bypass around the diverter cup. The diverter cup may be mounted on the elongate body and may be restrained against axial movement during run-in of the device, and adapted for movement in an axial direction relative to the device during run-out, thereby facilitating opening of the bypass slot.

Preferably also, the device comprises a main debris chamber or area which may be formed in or defined in or by the return flow passage, for receiving debris. Typically, the main debris chamber is adapted for receiving relatively large debris such as part of a tool, tool string or junk, in a fishing operation. The device and in particular the main debris chamber may include at least one magnet for retrieving ferrous material. It will be understood that references herein to "ferrous" material or debris are to such material consisting of or comprising iron.

The device may also comprise a secondary debris chamber for receiving and storing debris entrained in fluid flowing along the return flow passage towards the chamber, which may be a decanting chamber. The device may comprise a deflecting surface for deflecting fluid flowing along the return flow passage into the secondary debris chamber, to cause solid debris entrained in the fluid to fall out of suspension from or entrainment in the fluid and to collect in the secondary debris chamber. The deflecting surface may be arranged such that fluid flowing along the return flow passage impinges on the deflecting surface, stalls and falls out of suspension.

The restriction may comprise or take the form of a nozzle, and may be releasably securable within or relative to the main body. This may facilitate removal of the nozzle for maintenance and/or replacement. The restriction may be arranged to jet fluid into the main fluid chamber and may extend into the chamber or may define a chamber inlet in a wall thereof.

The device may comprise a chamber housing, which may define or house a part of the main fluid chamber into which fluid exiting the restriction is directed, and the chamber outlet may extend from said part of the chamber. This may ensure that fluid flowing into the main fluid chamber along the main bore and through the restriction is directed into the chamber outlet and thus into the annulus. The restriction and the housing may be arranged or located such that there is an axial and/or radial spacing or gap between the restriction and the housing, said spacing facilitating flow of the part of the fluid returned to the chamber through the return flow passage into and along the chamber outlet.

The spacing between the restriction and the housing may be minimised in order to generate sufficient suction on the returned fluid whilst maintaining through-flow of fluid from the main bore, through the restriction into the main fluid chamber, and thus through the outlet to the annulus.

Preferably, the device comprises a deformable sleeve member mounted for movement relative to the body between a retracted or open position and an extended or closed position where the sleeve member substantially closes the body opening. This may facilitate closure of the opening to contain retrieved debris, and in particular may facilitate recovery of a fish, such as a tool, part of a tool, or tool string. The device may also comprise a guide member for guiding the sleeve member during movement between the retracted and the extended positions. The guide member may be shaped to cause the sleeve member to deform and close the opening, and may be adapted to cause the deformable sleeve member to define a cap or cover. The sleeve member may be mounted in an annular space defined in or by a wall of the body.

Also, the device may comprise an actuating mechanism for urging the sleeve member between the retracted and extended positions. The actuating mechanism may be fluid operated or actuated, and may comprise a piston, typically an annular piston, coupled to or defined by the sleeve member. The piston may be adapted to be translated axially relative to the body to move the sleeve member between the retracted and extended positions.

The actuating mechanism may comprise a control line, channel or passage for controlling movement of the sleeve member between the retracted and extended positions. Supply of fluid under pressure to the sleeve member along the control line may serve for moving the sleeve member between the retracted and extended positions. The control line may extend between the piston and the main bore to facilitate selective actuation of the sleeve member by fluid communication with the main bore.

The actuating mechanism may comprise a ball valve arrangement including a ball seat adapted to receive a ball for selectively closing or restricting fluid flow through the main bore. The ball seat may be provided in the main bore and, in embodiments of the invention, the device may comprise a sleeve mounted in the main bore and defining the ball seat. The actuating mechanism may be operated by running a ball into the device along the main bore, which ball may be received on the ball seat, restricting fluid flow and causing the pressure of the fluid behind the ball to increase, to urge the sleeve member to the extended position. The ball may be blown through the seat to reopen fluid flow along the main bore. To facilitate this, the ball and/or the ball seat may be deformable. In particular embodiments, the device may comprise a sleeve having a ball seat of the type disclosed in the Applicant's International Patent Publication Number WO 2004/088091 (Application Number PCT/GB2004/001449), the disclosure of which is incorporated herein by way of reference. In alternative embodiments, the ball seat may be provided on a mandrel which is moveable between a first position where the control line is closed and a second position where the control line is open, the mandrel moved between said positions by locating the ball on the ball seat to generate a fluid pressure force to move the mandrel.

The device may comprise a ball catcher provided below the ball seat and adapted to catch the ball following blow-through. The device may also comprise a bypass channel having an inlet upstream of the ball catcher and an outlet downstream of the ball catcher, to facilitate bypass flow past the ball when seated on the catcher.

In an alternative embodiment, the device may comprise tubing such as washover pipe coupled to the device, which may be in fluid communication with the body opening. Fluid circulated into the annulus may be directed into the washover pipe, along the pipe and into the body opening. Provision of the washover pipe may facilitate fluid circulation along a longer length of the wellbore in, for example, a cleaning operation. It will be understood that where the device comprises such washover pipe, the device may be provided without a deformable sleeve member, or the sleeve member may be deactivated or locked open. The tubing may vary in diameter to define one or more Venturi/restriction, if desired, to enhance fluid flow and entrainment of debris.

In preferred embodiments, the device comprises a plurality of chamber outlets, which may be disposed at an angle (non-parallel) and preferably declined relative to a main axis of the device. This may facilitate direction of fluid into the annulus and along the annulus to the device opening. The device may also comprise a plurality of fluid exits which may also be disposed at an angle and, in particular, may be inclined relative to a main axis of the device, to facilitate passage of fluid into the annulus and along the annulus to surface.

The opening may be provided lowermost on the body. The opening may be in an end of the body, and may be substantially perpendicular to a main axis of the device. This may facilitate washover of debris to be retrieved. Alternatively, the opening may be provided in a side wall of the body.

It will be understood that reference herein to a well borehole wall include an open-hole environment, and that the device may therefore be used for retrieving debris from an open well borehole; as well as to the wall of a tubing in a tubing lined borehole, such as a casing, liner or other downhole tubing.

According to a second aspect of the present invention, there is provided a method of retrieving debris from a well, the method comprising the steps of:

locating a device for retrieving debris from a well at a desired location within the well; directing fluid along a main bore defined by a body of the device and into a main fluid chamber of the body;

directing the fluid from the main fluid chamber through at least one chamber outlet and into an annulus defined between the device and a wall of a borehole of the well; and circulating the fluid along the annulus, through an opening provided towards a lower end of the body and along a return flow passage to the main fluid chamber, to facilitate retrieval of debris from the well;

whereby the step of directing fluid along the main bore and into the main fluid chamber comprises jetting the fluid through a restriction in the main bore which accelerates the fluid such that the pressure of fluid exiting the restriction is lower than at a location upstream thereof, thereby drawing part of the fluid returning to the main fluid chamber along the return flow passage into and through the chamber outlet, to recirculate said part of the fluid into the annulus.

According to a third aspect of the present invention, there is provided a device for use in retrieving an object from a well, the device comprising:

an elongate body;

a main bore extending part way along a length of the body, along which fluid flows into the device;

an opening towards a lower end of the body;

a main fluid chamber in the body in fluid communication with the main bore;

a flow restriction provided in the main bore, through which fluid flows from the main bore and into the main fluid chamber;

at least one chamber outlet for directing fluid from the main fluid chamber into an annulus defined between the body and a well borehole wall;

a return flow passage extending between the body opening and the main fluid chamber, for return flow of fluid from the annulus to the main fluid chamber, to facilitate retrieval of an object from the well; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

According to a fourth aspect of the present invention, there is provided a device for use in cleaning a well, the device comprising:

an elongate body;

a main bore extending part way along a length of the body, along which fluid flows into the device;

an opening towards a lower end of the body;

a main fluid chamber in the body in fluid communication with the main bore;

a flow restriction provided in the main bore, through which fluid flows from the main bore and into the main fluid chamber;

at least one chamber outlet for directing fluid from the main fluid chamber into an annulus defined between the body and a well borehole wall;

a return flow passage extending between the body opening and the main fluid chamber, for return flow of fluid from the annulus to the main fluid chamber, to facilitate cleaning of the well; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

According to a fifth aspect of the present invention, there is provided a device for use in retrieving debris from a well, the device comprising:

an elongate body;

a main fluid chamber;

a first fluid flow path extending along the body to the main fluid chamber, for flow of fluid into the device;

a second fluid flow path extending from the main fluid chamber into an annulus defined between the device and a well borehole wall; and a third fluid flow path extending between an opening provided towards a lower end of the body and along the body to the main chamber;

whereby, in use, fluid flowing into the main chamber along the first flow path is directed into the annulus along the second flow path, circulated along the annulus, and returned to the main chamber along the third flow path;

and wherein the device is adapted to recirculate part of the fluid returned to the main fluid chamber into the annulus.

Further features of the devices of the third, fourth and fifth aspects of the invention in common with the first aspect are defined above.

BRIEF DESCRIPTION OF DRAWINGS

An embodiment of the present invention will now be described, by way of example only, with reference to the accompanying drawings, in which.

DETAILED DESCRIPTION

Figure 1:
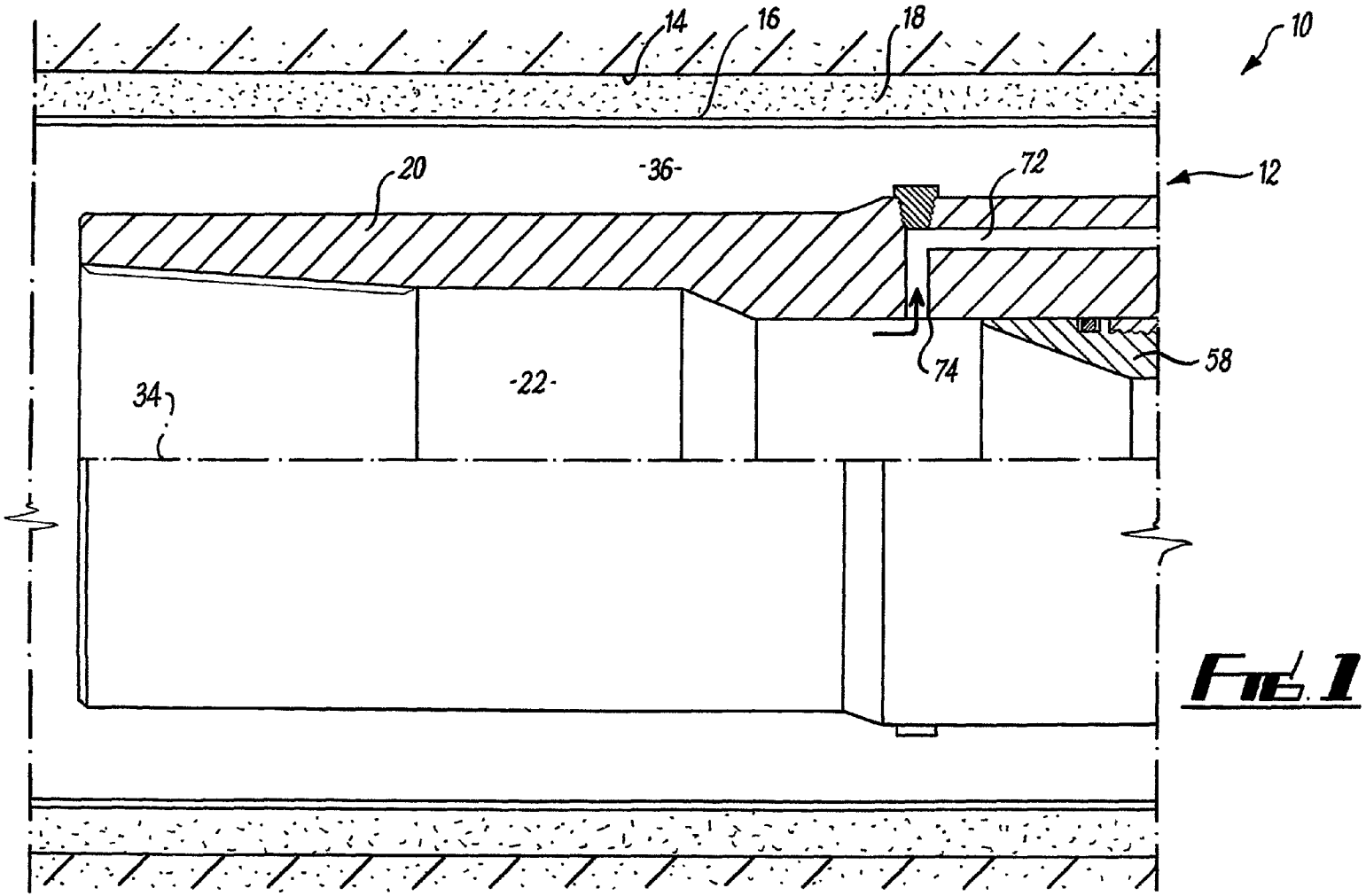
FIGS. 1 to 7 are longitudinal half-sectional views of a device for use in retrieving debris from a well, in accordance with an embodiment of the present invention, the device illustrated from top to bottom from FIG. 1 through to FIG. 7, and with a sleeve member of the device shown in a retracted position in the upper half of FIGS. 6 and 7 and in an extended position in the lower half of FIGS. 6 and 7.
Figure 5:
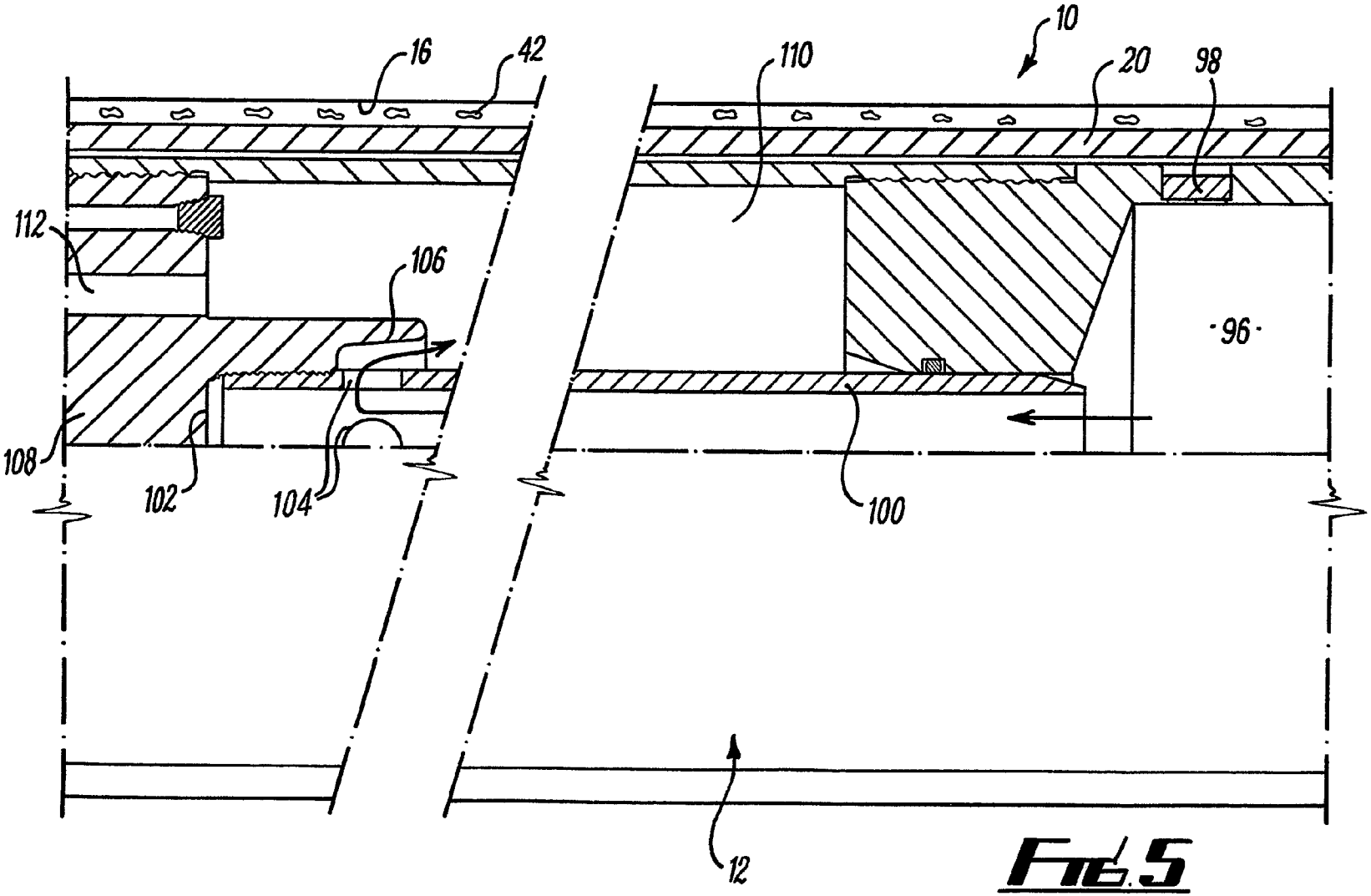
Figure 6:
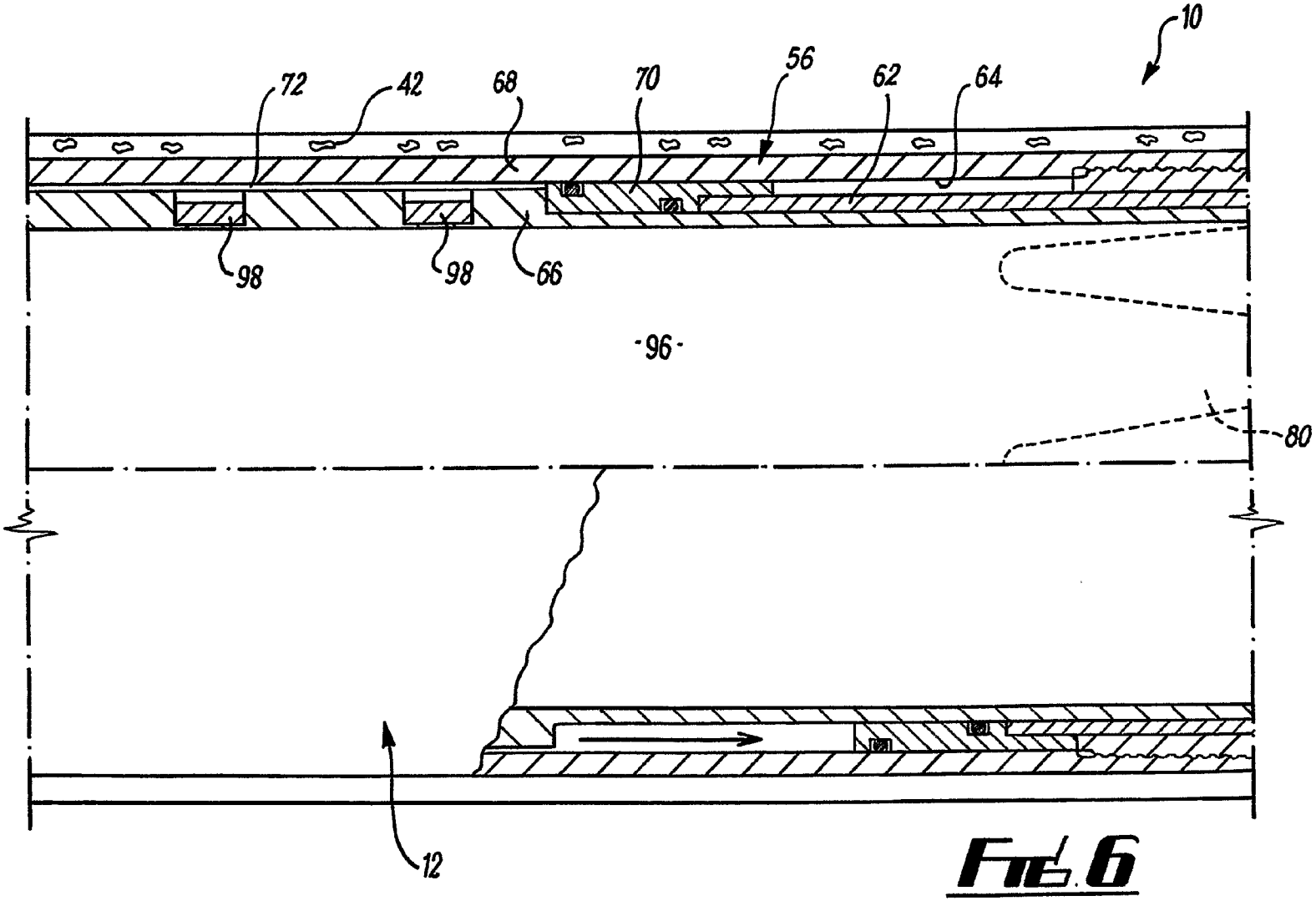
Figure 7:
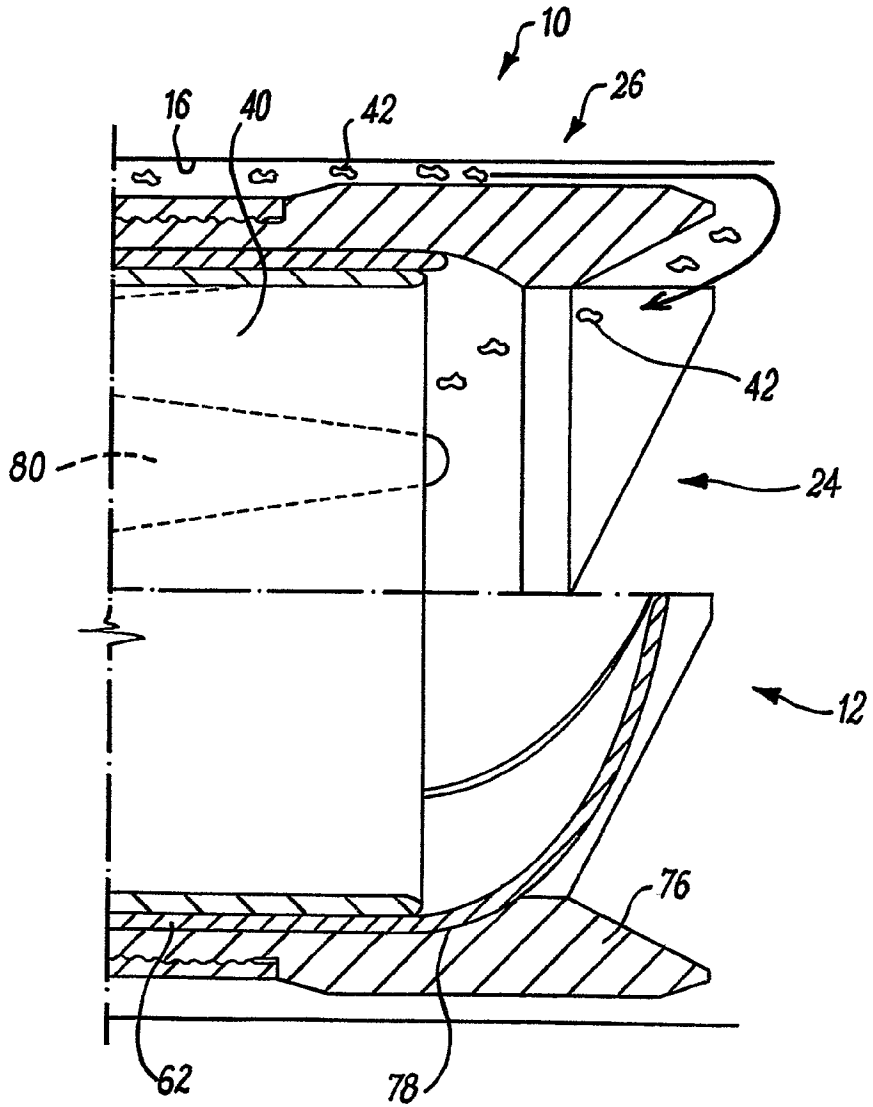

Turning firstly to FIGS. 1 to 7, there are shown longitudinal half-sectional views of a device for use in retrieving debris from a well 10, the device shown from top to bottom from FIG. 1 through to FIG. 7, and indicated generally by reference numeral 12. The well 10 is an oil or gas well and comprises a wellbore or borehole 14 which has been drilled from surface to gain access to subterranean hydrocarbon bearing rock formations, and which has been lined with a steel casing 16 that has been cemented in place at 18, in a fashion known in the art. For ease of illustration, the borehole 14 is only shown in detail in FIG. 1.

The device 12 is utilised for retrieving debris from a well, which may comprise part of a tool or tool string (not shown) located in the borehole 16, or other junk typically found downhole. The device 12 may therefore be utilised in a "fishing" operation, to retrieve part of a tool which has become lodged and stuck in the casing 16. However, the device 12 may also be utilised for retrieving other debris such as cement lumps, rocks, congealed mud, oxidation lumps, metal debris, scale, slivers, shavings, burrs, dislodged mud cake residue, drill cuttings or the like which has accumulated in the casing 16, and which is to be cleaned and removed prior to completion of the well 10.

The device 12 is typically run-in to the casing 16 on a string of tubing (not shown), and includes an elongate body 20 having a main bore 22 which extends part-way along a length of the body 20 and along which fluid flows into the device 12. The device 12 also includes an opening 24 towards a lower end 26 of the body 20, and a main fluid chamber 28 in the body 20, which is in fluid communication with the main bore 22. A flow restriction in the form of a nozzle 30 is provided in the main bore 22, and fluid flows from the main bore 22 through the nozzle 30 and into the main chamber 28. As will be described below, the nozzle causes creates a Venturi-like effect on the fluid flowing along the main bore 22 into the device 12.

The device 12 also includes at least one chamber outlet and, in the illustrated embodiment, includes four chamber outlets 32 which are disposed at an angle (non-parallel) and declined relative to a main axis 34 of the device 12. The chamber outlets 32 serve for directing fluid from the chamber 28 and into an annulus 36 defined between the body 20 and a well borehole wall which, in the illustrated embodiment, is a wall 38 of the casing 16. A return flow passage 40 extends between the body opening 24 and the main chamber 28, for return flow of fluid from the annulus 36 to the chamber 28, to facilitate retrieval of debris particles 42 from the well 10, which are shown in the upper half of FIGS. 4 to 7. The device 12 also includes at least one fluid exit and, in the illustrated embodiment, includes four fluid exits 44 which are angled (non-parallel) and inclined relative to the device main axis 34, for flow of fluid returned to the main chamber 28 through the return flow passage 40 out of the device 12.

In use of the device 12, fluid flowing through the main bore 22 is accelerated through the nozzle 30 such that the pressure of fluid exiting the nozzle 30 in the region of a location 45 is lower than in the region of a location 46 upstream of the nozzle 30 outlet. In the illustrated embodiment, the pressure $p_1$ of fluid at the location 46 is thus greater than the pressure $p_2$ of the fluid exiting the nozzle 30 at location 45. This reduction in pressure of the fluid creates a suction, causing part of the fluid returning to the main chamber 28 through the return flow passage 40 to be drawn into and through the chamber outlets 32, thereby recirculating said part of the fluid into the annulus 36.

This achieves the effect of circulating a greater volume of fluid per unit time into the annulus 36 relative to the volume of fluid pumped per unit time into the device 12 along the main bore 22. For example, a fluid such as brine may be pumped into the device main bore 22 through a tool string coupled to the device 12 at a flow rate of 5 bpm. This fluid flows down the main bore 22 and is jetted through the nozzle 30 into the main chamber 28, exiting the chamber 28 along the chamber outlets 32, flowing down the annulus 36 and re-entering the device 12 through the opening 24, carrying debris particles 42. The fluid then flows up through the return flow passage 40 and into the chamber 28, where the suction effect created due to the reduction in pressure of fluid flowing through the nozzle 30 draws a portion, in this case, 2 bpm of fluid out of the return flow stream. Thus a flow rate of 7 bpm through the chamber outlets 32 and into the annulus 36 is achieved, with 5 bpm flowing along the fluid exits 44 and into the annulus 36 at an upstream location. It will therefore be understood that in use and following start-up of the device 12, 5 bpm of fluid is pumped into and out of the device, whilst 7 bpm is circulated from the main chamber 28, into the annulus 36 and back to the chamber 28 along the return flow passage 40. It will be understood that the fluid flow rates discussed above are exemplary and that the typical flow rates will vary depending upon factors such as particular tool dimensions and relative component positioning and the environment in which the device 12 is to be utilised.

For a defined volume of fluid pumped into the device 12 and returned from the device 12 to surface, a relatively larger flow rate of fluid into the annulus may thus be achieved. It will therefore be understood that the present invention provides much improved performance of retrieving debris, such as the debris particles 42 from the borehole 14, when compared to prior, known devices. Furthermore, in the case where the device 12 is used to retrieve a fish (not shown) from the borehole 14, the circulation of fluid to the annulus 36 achieved in use of the tool greatly enhances washover of the fish and thus enhances the fishing process.

Figure 4:
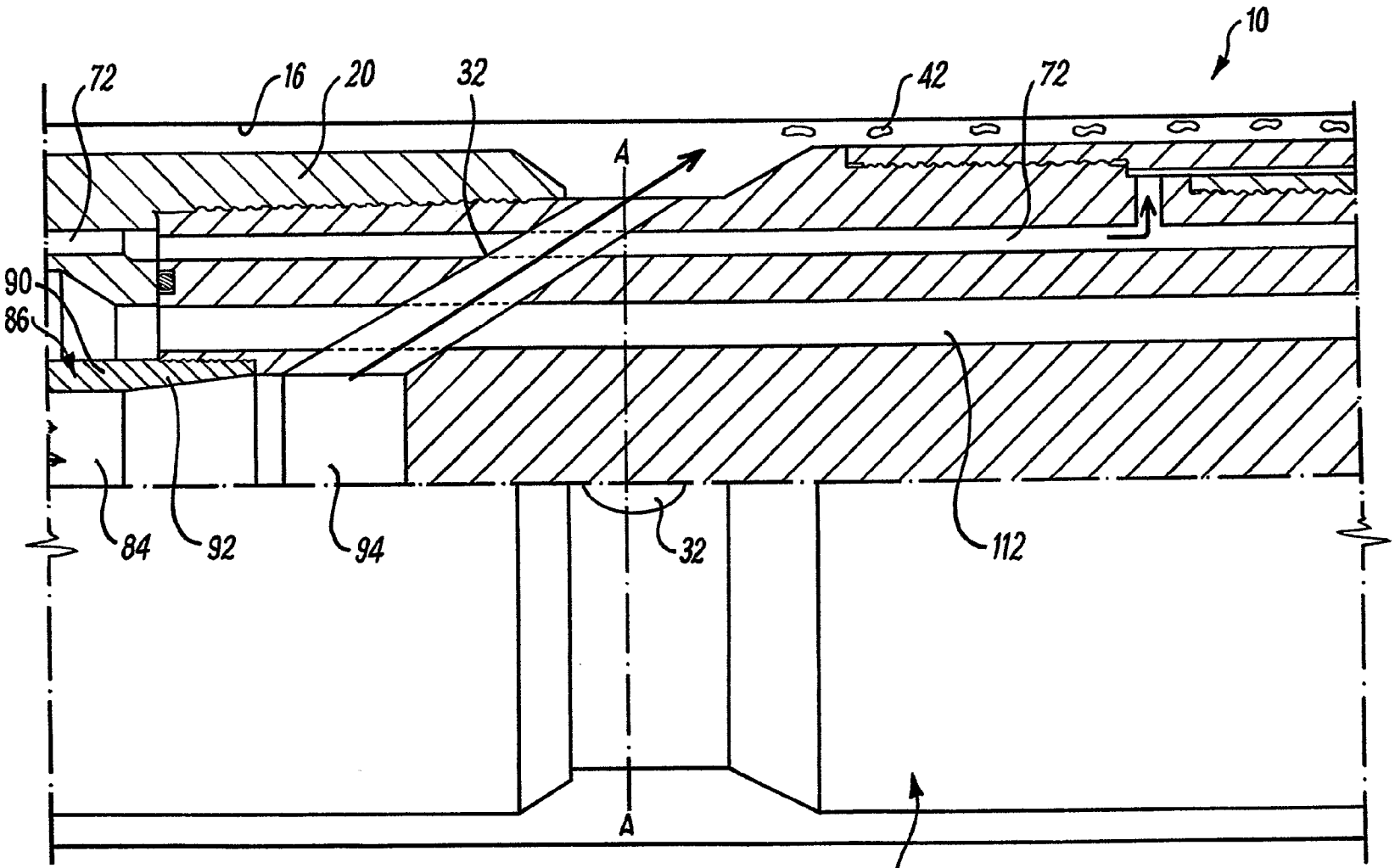
Figure 9:
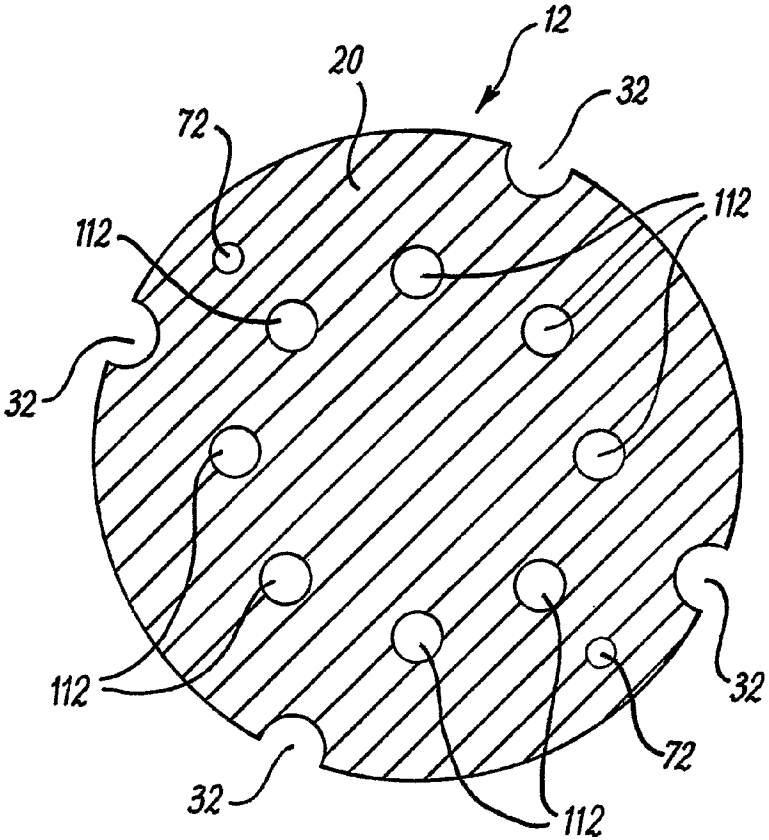
FIG. 9 is a cross-sectional view of the device of FIGS. 1 to 6 taken about the line A-A of FIG. 4.
Figure 8:
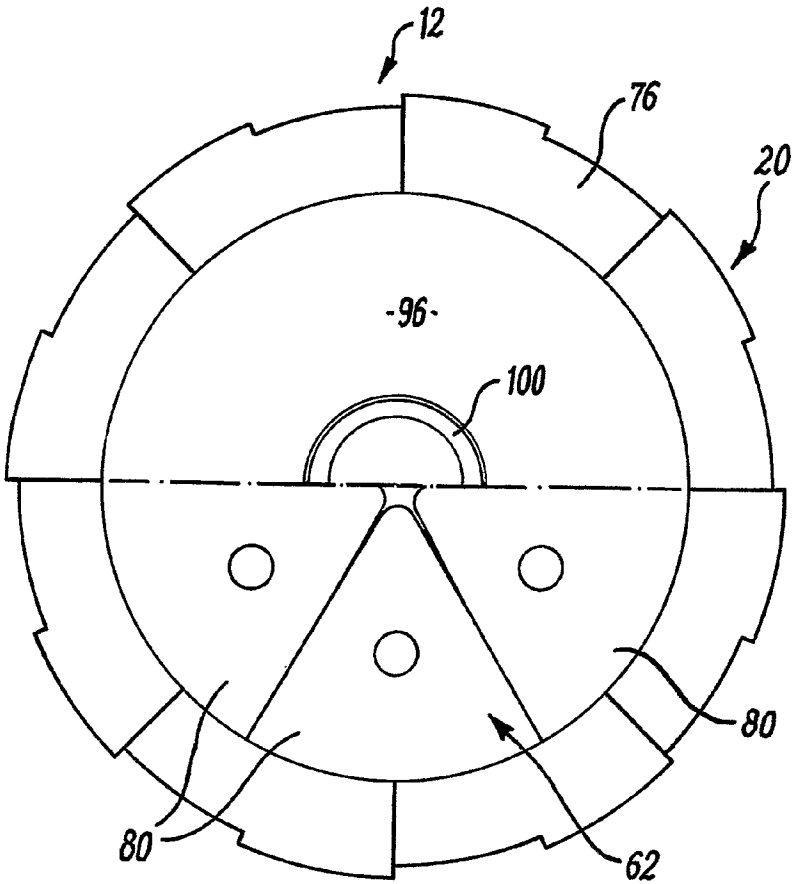
FIG. 8 is a bottom view of the device of FIGS. 1 to 7.

The device 12 and its method of operation will now be described in more detail, with reference also to FIG. 8, which is a bottom view of the device 12, and to FIG. 9, which is a cross-sectional view of the device 12 taken about the line A-A shown in FIG. 4.

Figure 2:
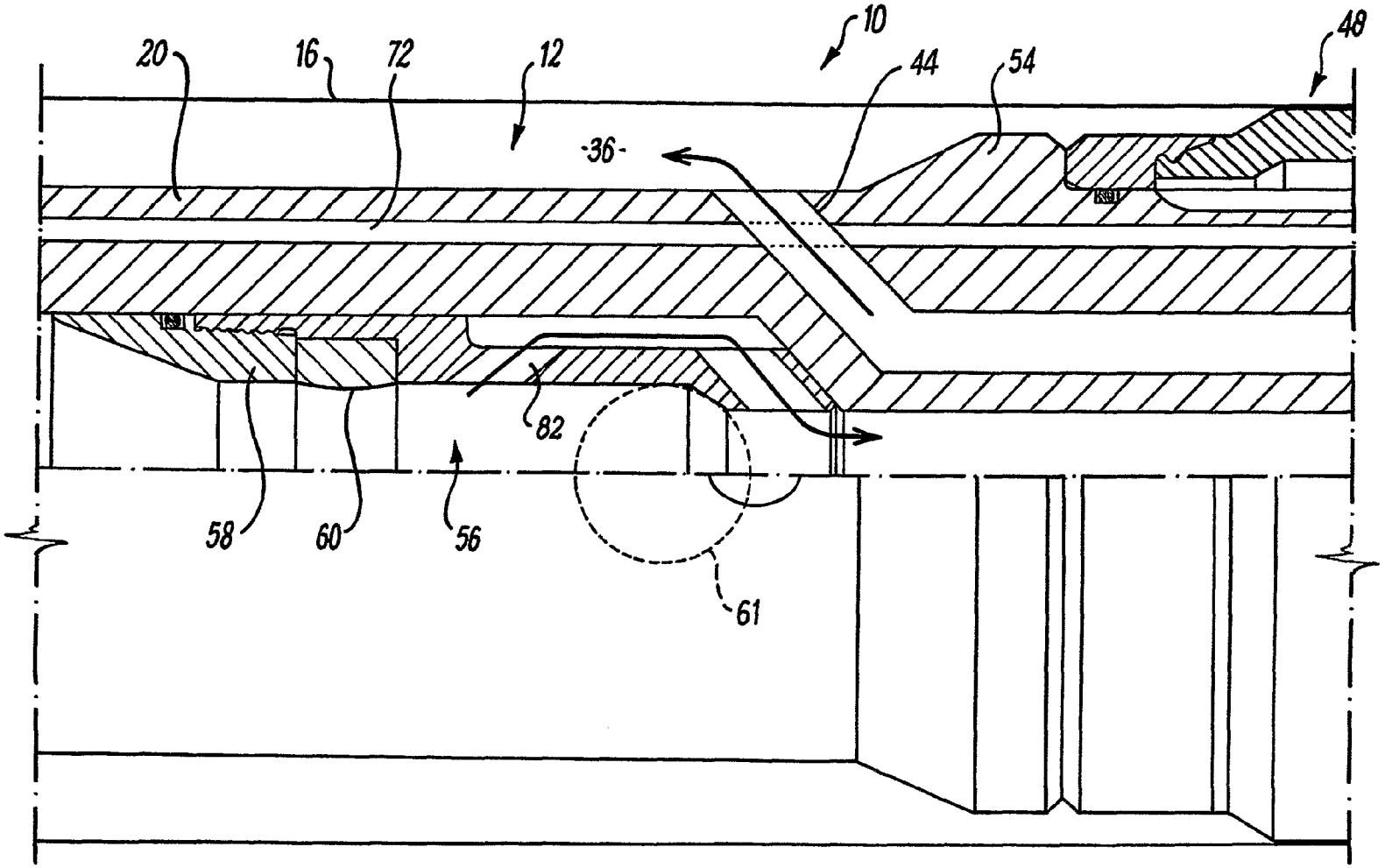
Figure 3:
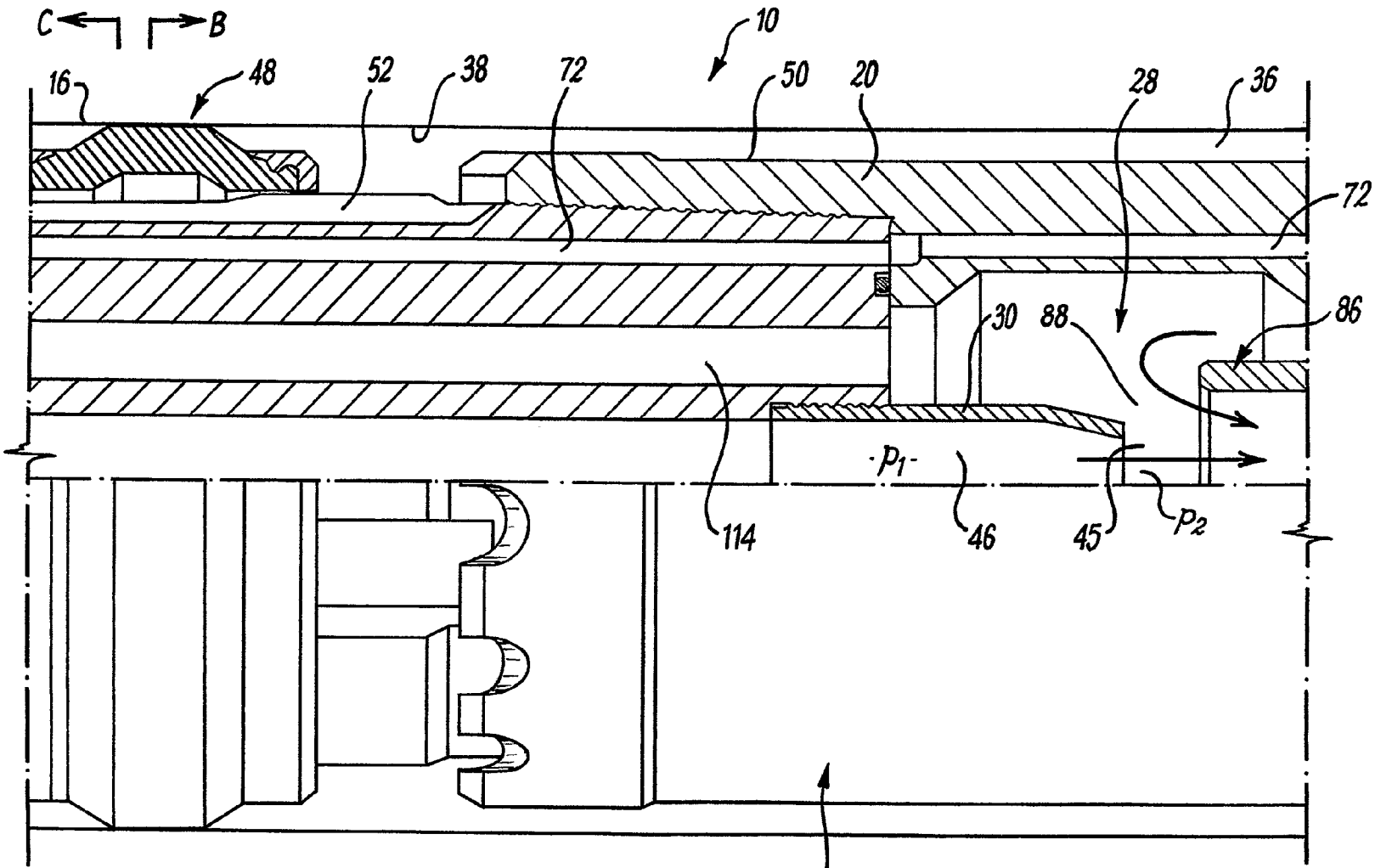

In addition to the basic components described above, the device 12 comprises a seal member in the form of a diverter cup 48 which is shown in FIGS. 2 and 3. The diverter cup 48 serves for sealing the annulus 36 to substantially prevent or restrict flow of fluid along the annulus 36 in an uphole direction past the cup 48. The cup 48 effectively provides a selective seal between the casing wall 38 and an outer surface 50 of the device body 20, to prevent fluid flow along the annulus 36. The diverter cup 48 is mounted for axial movement relative to the device body 20 between a first position shown in the figures and a second, axially displaced position (not shown). Specifically, the diverter cup 48 is moveably mounted on the device body 20 and is moveable in a direction B (FIG. 3) to selectively open a number of bypass slots 52 formed in the device body 20. The cup 48 is mounted such that it is restrained against movement in the direction of the arrow C (FIG. 3) during run-in of the device 12, by a shoulder or upset 54 formed on the body 20. Thus during run-in of the device 12 into the borehole 14, the cup 48 is held in the position shown in FIGS. 2 and 3 and seals the annulus 36.

In a similar fashion, in use of the device 12, there is a positive pressure differential across the cup 48 in a downhole to an uphole direction, holding the cup 48 against the shoulder 54 and thus maintaining the annulus 36 sealed. However, when the device 12 is returned to surface, frictional contact between the diverter cup 48 and the wall 38 of the casing 16 causes a movement of the body 20 relative to the cup 48 in the direction C, opening the bypass slots 52 and allowing pressure equalisation across the cup. The cup 48 therefore serves both for preventing fluid directed into the annulus 36 through the chamber outlets 32 from flowing in an uphole direction past the cup, thereby maximising the volume of fluid circulated downhole; and facilitates safe withdrawal of the device 12 by permitting pressure equalisation.

The device 12 also includes an actuating mechanism 56, part of which is shown in FIG. 2, in the form of an actuating sleeve 58. The sleeve 58 defines a ball valve seat 60 which is adapted to receive a ball shown in broken outline at 61 in FIG. 2. The actuating mechanism 56 serves for moving a deformable sleeve member 62 between a retracted position shown in the upper half of FIGS. 6 and 7, and an extended position shown in the lower half. As will be understood from the bottom view of FIG. 8, which again shows the deformable sleeve member in the extended position in the bottom half of the figure, in the extended position, the sleeve member 62 closes the opening 24. This permits retrieval of debris by allowing optional closing of the opening 24 prior to tripping-out of the device 12.

The sleeve member 62 is typically of a deformable metal such as an aluminium alloy, and is mounted in an annular space 64 which is defined by inner and outer sleeves 66 and 68 of the elongate body 20. The actuating mechanism 56 also includes an annular piston 70 which abuts the deformable sleeve member 62, and which serves for urging the sleeve member between the retracted and extended positions. Movement of the piston 70 is controlled through a control line or channel 72, which extends along the body 20, and includes an inlet 74 (FIG. 1) upstream of the actuating sleeve 58.

In this fashion, when the ball 61 is pumped down through the string into the device main bore 22 and lands on the ball valve seat 60, the ball 61 creates a restriction to fluid flow along the main bore 22. This generates a back-pressure which is felt by the annular piston 70 by fluid communication with the area upstream of the ball valve seat 60, through the control line 72. This causes the piston 70 to be urged axially downwardly, carrying the deformable sleeve member 62 towards the extended, closed position shown in the lower half of FIGS. 7 and 8. To facilitate movement of the sleeve member 62 to the closed, deformed position, the device 12 includes a guide member in the form of a collar 76 provided lowermost on the device 12, and which has a dished or curved inner surface 78 shaped to direct the sleeve 62 radially inwardly during its passage from the retracted position, thereby closing the opening 24. Also, the sleeve 62 includes a number of tapered fingers 80 (shown in broken outline in FIGS. 6 and 7) which come together to form a cap or shell that closes the opening 24. These fingers 80 may be provided with cutting surfaces, edges or blades to assist both in passage to the extended, closed position and to assist in retrieving debris.

The arrangement of the actuating sleeve 58 and ball valve seat 60 may be of the type disclosed in the Applicant's International Patent Publication Number WO 2004/088091, the disclosure of which is incorporated herein by way of reference. The ball 61 and/or ball seat 60 may thus be deformable such that on feeling sufficient back-pressure, the ball 61 is blown through the valve seat 60. This permits reopened fluid flow along the main bore 22 past the ball 61 through a bypass 82 formed in the actuating sleeve 58. However, it will be understood that alternative arrangements permitting reopened flow along the main bore 22 may be utilised.

Considering now the main chamber 28 and nozzle 30, the body 20 includes a chamber part or portion 84 defined by a housing 86, and the nozzle 30 is arranged relative to the housing 86 so as to define a gap or space 88 therebetween. The axial and/or radial spacing of the nozzle 30 relative to the housing 86 is selected such that a maximum suction of fluid flowing into the chamber 28 along the return flow passage 40 may be achieved. The housing 86 includes a throat 90 and a diffuser 92 which feeds fluid entering the housing 86 into an area 94 of the chamber 28, and thus into the chamber outlets 32.

Considering now the return flow passage 40 in more detail, as discussed above, the return flow passage 40 extends from the device opening 24 to the main, fluid chamber 28. The flow passage 40 forms a main debris chamber 96 in which ferrous and relatively large debris such as junk is received, and a number of axially spaced annular magnets 98 are mounted in the inner sleeve 66 around the main debris chamber 96. These magnets 98 serve for attracting and retaining ferrous debris in the device 12. Thus it will be understood that ferrous and relatively large debris is retained within the chamber 96.

Fluid flowing along the flow passage 40 continues out of the main debris chamber 96 and along a feed pipe 100, which is closed at an end 102 and includes a number of circumferentially spaced radial flow ports or apertures 104, two of which are shown in FIG. 5. A deflecting surface in the form of an annular lip 106 is defined by an inner sleeve 108 of the body 20, and fluid flowing from the feed pipe 100 through the flow ports 104 impinges on the deflecting surface 106. The return flow passage 40 is thus relatively convoluted, and this directs the fluid downwardly and then upwardly, causing solid debris suspended or entrained in the flowing fluid to settle out in a secondary or decanting chamber 110, which may be cleaned to remove collected debris when the device 12 is returned to surface. The return flow passage 40 includes a bore 112 which extends from the secondary chamber 110 to the main fluid chamber 28, and a bore 114 which extends from the main chamber 28 and is in fluid communication with a respective fluid exit 44. Thus a number of the bores 112, 114 are defined by the device 12.

In use, the device 12 is run-in to the casing 16 with the diverter cup 48 in the upper position shown in FIGS. 2 and 3, and with the annular piston 70 (and thus the deformable sleeve member 62) in the retracted position shown in the upper half of FIGS. 6 and 7. The device 12 is positioned at a desired location within the casing 16, for example, where it is desired to carry out a cleaning procedure to retrieve debris particles 42, or to retrieve a fish. Fluid is then pumped down through the string, along the device main bore 22 and is jetted through the nozzle 30 into the main fluid chamber 28. The fluid enters the housing 86 and passes into the area 94, from where it is directed out of the chamber 28 along the chamber outlets 32 and into the annulus 36. The fluid flows down along the annulus 36, carrying the drill cuttings 42, and returns into the device 12 through the lower opening 24. The fluid then flows up through the return flow passage 40, larger debris such as junk and ferrous debris being retained in the main debris chamber 96, with smaller/non-ferrous debris carried in the fluid along the feed pipe 100 and into the secondary decanting chamber 110, where it settles out. The fluid then continues along the bore 112 and re-enters the main fluid chamber 28.

The suction created by the lower pressure $p_2$ of the fluid jetted through the nozzle 30 creates a suction effect, drawing in part of the fluid returned to the chamber 28 through the flow passage 40, which is then recirculated to the annulus 36. The remaining returned fluid is directed to the annulus 36 above the diverter cup 48, through the bores 114 and fluid exits 44.

Once all of the debris particles 42 have been retrieved and it is desired to return the device 12 to surface for cleaning and subsequent reuse, the ball 61 is pumped down through the string, into the main bore 22 and lands on the ball valve seat 60. This closes the main bore 22, creating a back-pressure which urges the annular piston 70 downwardly, carrying the deformable sleeve member 62 from the retracted position shown in the upper half of FIGS. 6 and 7 to the extended position. The tapered fingers 80 are thus brought together, closing the opening 24, and the device 12 can then be pulled and tripped-out of the casing 16, retaining debris held in the main debris chamber 96. This movement of the device 12 carries the body 20 upwardly relative to the diverter cup 48, equalising pressure across the cup to enable safe retrieval.

Alternatively, it may not be desired or necessary to close the opening 24. For example, it may only be necessary to close the opening if relatively large debris such as junk or a fish has been retrieved. Accordingly, the device 12 may be pulled without closing the opening 24, thus retaining the deformable sleeve member 62 for future use.

At surface, the device 12 may be cleaned by removing retrieved debris and the deformed sleeve 62 replaced (if required) with a fresh sleeve. The device 12 is then ready for re-use in a further procedure.

Figure 10:
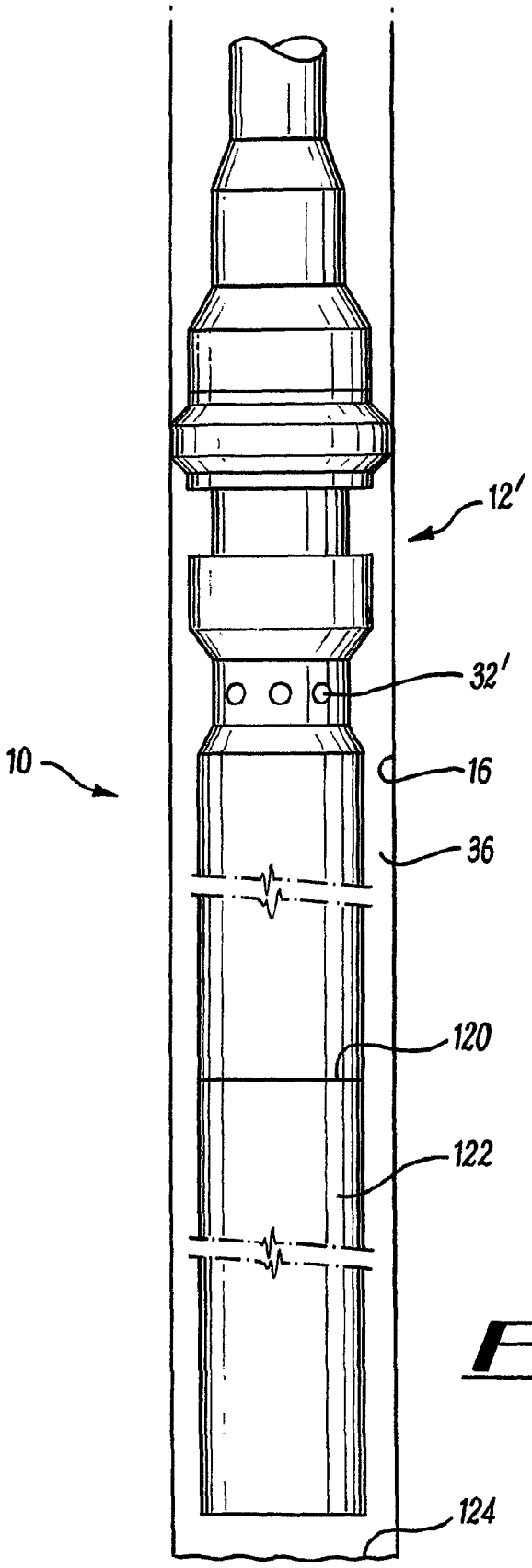
FIG. 10 is a longitudinal view of a device for use in retrieving debris from a well, in accordance with an alternative embodiment of the present invention.

Turning now to FIG. 10, there is shown a longitudinal view of a device for use in retrieving debris from a well in accordance with an alternative embodiment of the present invention, the device indicated generally by reference numeral 12'. Like components of the device 12' with the device 12 of FIGS. 1-9 share the same reference numerals with the addition of the suffix'.

The device 12' is essentially similar to the device 12 of FIGS. 1-9, save that the device does not include a deformable sleeve member such as the sleeve member 62 of the device 12. Instead, the device 12' is coupled at 120 by a standard threaded connection to a length of washover pipe 122. This facilitates use of the device 12' in a reverse circulation operation, for example, to clean the base 124 of a well such as the well 10 of FIGS. 1-9, fluid circulated into the annulus 36 flowing along the annulus from the outlets 32' and thereby providing a cleaning function along a greater length of the well casing 16.

Various modifications may be made to the foregoing without departing from the spirit and scope of the present invention.

For example, the device may be for use in retrieving any suitable debris from a wellbore. The device may comprise a plurality of restrictions and fluid flow chambers, each restriction arranged to jet fluid flowing through the main bore into a respective chamber.

The device may include an opening provided in a side wall of the body, which may be spaced from a lower end of the body.

The device may include further debris chambers for collecting/sorting debris at different areas or locations along a length of the return flow passage.

The invention claimed is:

1. A device for use in retrieving debris from a well, the device comprising:

an elongate body having an upper and a lower end;

a main bore extending part way along a length of the body, along which fluid flows into the device;

an opening towards the lower end of the body;

a primary debris chamber within the lower end for receiving and retaining debris, said debris chamber including at least one magnet for retrieving ferrous material;

a main fluid chamber in the body in fluid communication with the main bore;

a flow restriction provided in the main bore including a nozzle configured to accelerate fluid flow toward the lower end, and through which fluid flows from the main bore and into the main fluid chamber;

at least one chamber outlet for directing fluid from the main fluid chamber into an annulus defined between the device and a well borehole wall;

a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

2. The device as claimed in claim 1, wherein the device is a reverse-circulation device.

3. The device as claimed in claim 1, wherein the restriction forms a venturi.

4. The device as claimed in claim 1, wherein the device is a fishing tool.

5. The device as claimed in claim 1, comprising a seal member for sealing the annulus, to substantially prevent flow of fluid along the annulus in an uphole direction.

6. The device as claimed in claim 5, wherein the seal member is located axially between the chamber outlet and the fluid exit, such that the seal member defines a barrier between the fluid entering the annulus along the chamber outlet and the fluid exiting the device along the fluid exit into the annulus.

7. The device as claimed in claim 5, wherein the seal member is adapted to sealingly abut the well borehole wall.

8. The device as claimed in claim 5, wherein the seal member is adapted to permit axial movement of the device relative to the well borehole wall whilst retaining a sealing function.

9. The device as claimed in claim 5, wherein the seal member is axially moveable relative to the elongate body to selectively permit fluid flow along the annulus past the seal member.

10. The device as claimed in claim 9, wherein the device comprises a bypass channel and wherein the seal member is moveable between a position where the bypass channel is closed and a position where the bypass channel is open, facilitating fluid bypass around the seal member.

11. The device as claimed in claim 10, wherein the seal member is mounted on the elongate body, restrained against axial movement during run-in of the device, and adapted for movement in an axial direction relative to the device during run-out, thereby facilitating opening of the bypass channel.

12. The device as claimed in claim 1, comprising a deflecting surface for deflecting fluid flowing along the return flow passage into the secondary debris chamber, to cause solid debris entrained in the fluid to fall out of suspension from the fluid and to collect in the secondary debris chamber.

13. The device as claimed in claim 12, wherein the deflecting surface is arranged such that fluid flowing along the return flow passage impinges on the deflecting surface, stalls and falls out of suspension.

14. The device as claimed in claim 1, wherein the restriction extends into the main fluid chamber and is arranged to jet fluid into the main fluid chamber.

15. The device as claimed in claim 1, comprising a deformable sleeve member mounted for movement relative to the body between a retracted position, and an extended position, in the extended position, the sleeve member substantially closing the body opening.

16. The device as claimed in claim 15, comprising a guide member for guiding the sleeve member during movement between the retracted and the extended positions.

17. The device as claimed in claim 15, comprising a fluid operated actuating mechanism for urging the sleeve member between the retracted and extended positions.

18. The device as claimed in claim 17, comprising a ball valve arrangement including a sleeve mounted in the main bore and defining a ball seat adapted to receive a ball for selectively restricting fluid flow through the main bore, and wherein the actuating mechanism is adapted to be operated by running a ball into the device along the main bore, which ball is received on the ball seat, restricting fluid flow and causing the pressure of the fluid behind the ball to increase, to cause the sleeve member to be moved to the extended position.

19. The device as claimed in claim 1, comprising a washover pipe in fluid communication with the body opening, and wherein fluid circulated into the annulus is directed into the washover pipe, along the pipe and into the body opening.

20. The device as claimed in claim 1, comprising a plurality of chamber outlets, the chamber outlets disposed at a non-parallel angle relative to a main axis of the device, to facilitate passage of fluid into the annulus and along the annulus to the device opening.

21. The device as claimed in claim 1, comprising a plurality of fluid exits disposed at a non-parallel angle relative to a main axis of the device, to facilitate passage of fluid into the annulus and along the annulus to surface.

22. The device as claimed in claim 1, wherein the opening is provided lowermost on the body in an end thereof.

23. The device as claimed in claim 1, further comprising a housing within the main fluid chamber and spaced from the nozzle, which housing includes a throat and a diffuser configured to feed fluid entering the housing from the nozzle into an area of the main fluid chamber, and thus into the chamber outlet.

24. The device as claimed in claim 23, wherein a location of the flow restriction relative to the chamber housing is adjustable, to permit variation of an axial separation between an end of the restriction and the chamber housing.

25. The device as claimed in claim 23, wherein the nozzle and the housing are arranged so as to define a gap therebetween, the gap spacing being sufficient to provide for a maximum suction of fluid flowing into the main fluid chamber along the return flow passage.

26. A method of retrieving debris from a well, the method comprising the steps of:

locating a device for retrieving debris from a well at a desired location within the well, the device comprising:
- an elongate body having an upper end and a lower end;
- a main bore extending part way along a length of the elongate body, along which fluid flows into the device;
- an opening towards the lower end of the body;
- a primary debris chamber within the lower end for receiving and retaining debris, said debris chamber including at least one magnet for retrieving ferrous material;
- a main fluid chamber in the body in fluid communication with the main bore;
- a flow restriction provided in the main bore including a nozzle configured to accelerate fluid flow towards the lower end, and through which fluid flows from the main bore and into the main fluid chamber;
- at least one chamber outlet for directing fluid from the main fluid chamber into an annulus defined between the device and a well borehole wall;

a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber; and
- at least one fluid exit for flow of fluid returned to the main fluid chamber through the return flow passage out of the device;

directing fluid along the main bore defined by a body of the device and into the main fluid chamber of the body;

directing the fluid from the main fluid chamber through said at least one chamber outlet and into the annulus defined between the device and a wall of a borehole of the well; and circulating the fluid along the annulus, through the opening provided towards the lower end of the body and along the return flow passage to the main fluid chamber, to facilitate retrieval of debris from the well;

whereby the step of directing fluid along the main bore and into the main fluid chamber comprises jetting the fluid through the restriction in the main bore which accelerates the fluid such that the pressure of fluid exiting the restriction is lower than at a location upstream thereof, thereby drawing part of the fluid returning to the main fluid chamber along the return flow passage into and through the chamber outlet, to recirculate said part of the fluid into the annulus.

27. A device for use in retrieving an object from a well, the device comprising:
- an elongate body having an upper end and a lower end;
- a main bore extending part way along a length of the body, along which fluid flows into the device;
- an opening towards the lower end of the body;
- a primary debris chamber within the lower end for receiving and retaining an object;
- a main fluid chamber in the body in fluid communication with the main bore;

a flow restriction provided in the main bore, through which fluid flows from the main bore and into the main fluid chamber;

at least one chamber outlet for directing fluid from the main fluid chamber into an annulus defined between the body and a well borehole wall;

a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

28. A device for use in cleaning a well, the device comprising:

an elongate body having an upper end and a lower end;

a main bore extending part way along a length of the body, along which fluid flows into the device;

an opening towards the lower end of the body;

a primary debris chamber within the lower end for receiving and retaining debris, said debris chamber including at least one magnet for retrieving ferrous material;

a main fluid chamber in the body in fluid communication with the main bore;

a flow restriction provided in the main bore including a nozzle configured to accelerate fluid flow towards the lower end, and through which fluid flows from the main bore and into the main fluid chamber;

at least one chamber outlet for directing fluid from the main fluid chamber into an annulus defined between the body and a well borehole wall;

a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber; and at least one fluid exit, for flow of fluid returned to the main fluid chamber through the return flow passage out of the device;

wherein, in use, fluid flowing through the main bore is accelerated through the restriction such that the pressure of fluid exiting the restriction is lower than at a location upstream thereof, to draw part of the fluid returned to the main fluid chamber through the return flow passage into and through the chamber outlet, thereby recirculating said part of the fluid into the annulus.

29. A device for use in retrieving debris from a well, the device comprising:

an elongate body having an upper end and a lower end, wherein the lower end comprises a body opening;

a main fluid chamber;

a primary debris chamber within the lower end of the elongate body for receiving and retaining debris;

a first fluid flow path extending along the body from the upper end to the main fluid chamber, for flow of fluid into the device;

a second fluid flow path extending from the main fluid chamber into an annulus defined between the device and a well borehole wall; and a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber, whereby, in use, fluid flowing into the main chamber along the first flow path is directed into the annulus along the second flow path, circulated along the annulus, and returned to the main chamber along the return flow passage;

and wherein the device is adapted to recirculate part of the fluid returned to the main fluid chamber into the annulus by generating a suction in the main chamber by restriction of flow of fluid from the first fluid flow path through the main bore into the main fluid chamber, thereby drawing said part of the fluid returned to the chamber along the return flow passage into the annulus again.

30. A device for use in retrieving debris from a well, the device comprising:

an elongate body having an upper end and a lower end;

a main bore extending part way along a length of the body, along which fluid flows into the device;

an opening towards the lower end of the body;

a main fluid chamber in the body in fluid communication with the main bore;

a flow restriction provided in the main bore including a nozzle configured to accelerate fluid flow towards the lower end, and through which fluid flows from the main bore and into the main fluid chamber;

at least one chamber outlet for directing fluid from the main fluid chamber into an annulus defined between the device and a well borehole wall;

a primary debris chamber within the lower end of the elongate body for receiving and retaining debris;

a return flow passage for return flow of fluid from the annulus to the main fluid chamber, the return flow passage comprising a secondary debris chamber, wherein the return flow passage extends from the body opening, through the primary debris chamber and the secondary debris chamber, to the main fluid chamber; and at least one fluid exit, for flow of fluid returned to the main fluid chamber through the return flow passage out of the device;

wherein in use, the device recirculates part of the fluid returned to the main fluid chamber into the annulus by generating a suction due to flow of fluid from the main bore through the flow restriction and into the main fluid chamber, drawing said part of the fluid returned to the main fluid chamber along the return flow passage into and along the chamber outlet.

31. The device for use in retrieving debris from a well as claimed in claim 30, wherein the body includes a further chamber defined by a housing, and the nozzle is arranged relative to the housing so as to define a space therebetween to receive fluid from the main bore through the flow restriction and part of the fluid returned to the chamber along the return flow passage, and the further housing includes a throat and a diffuser which feeds fluid from the flow restriction and part of the fluid returned along the return flow passage into said at least one chamber outlet.

* * * * *